US008573425B1

(12) United States Patent
Park

(10) Patent No.: US 8,573,425 B1
(45) Date of Patent: Nov. 5, 2013

(54) DETACHABLE COUPLING APPARATUS FOR MIDSECTION OF SEPARABLE BOTTLE

(76) Inventor: Young Keun Park, Yongin-si (KR)

( * ) Notice: Subject to any disclaimer, the term of this patent is extended or adjusted under 35 U.S.C. 154(b) by 0 days.

(21) Appl. No.: 13/476,181

(22) Filed: May 21, 2012

(51) Int. Cl.
*B65D 6/00* (2006.01)

(52) U.S. Cl.
USPC ..... 220/4.05; 220/295; 220/300

(58) Field of Classification Search
USPC ..... 220/4.05, 4.03, 505, 298, 295, 4.26, 220/293, 300
See application file for complete search history.

(56) References Cited

U.S. PATENT DOCUMENTS 1,434,460 A * 11/1922 Tibbatts ..... 220/4.26
1,466,311 A * 8/1923 Mobley ..... 215/11.1
3,193,129 A * 7/1965 Pfluger et al. ..... 220/4.16
3,385,461 A * 5/1968 Mallin ..... 215/382
3,485,408 A * 12/1969 Benesch ..... 220/4.26
4,202,462 A * 5/1980 Imber ..... 220/293
4,267,940 A * 5/1981 Wade ..... 220/321
4,415,077 A * 11/1983 Murphy ..... 220/4.26
4,444,324 A * 4/1984 Grenell ..... 215/6
4,703,863 A * 11/1987 Kohus ..... 215/11.1
4,778,068 A * 10/1988 Kohus ..... 215/11.1
4,931,329 A * 6/1990 Sun ..... 428/36.92
5,072,851 A * 12/1991 Wilkes ..... 220/203.12
5,076,456 A * 12/1991 Geyer ..... 220/4.26
5,121,852 A * 6/1992 Wilkes ..... 220/203.12
5,285,933 A * 2/1994 Gentes et al. ..... 222/148
5,322,177 A * 6/1994 Coggings ..... 220/288
5,711,447 A * 1/1998 Plester ..... 220/254.1
6,116,439 A * 9/2000 Yaniv ..... 215/11.1
6,345,719 B1 * 2/2002 Jaycox ..... 206/570
6,402,798 B1 * 6/2002 Kallsen et al. ..... 55/385.3
D605,529 S * 12/2009 Holtrop ..... D9/746
7,673,763 B1 * 3/2010 Oh ..... 215/332
7,802,692 B2 * 9/2010 Maejima et al. ..... 220/293
8,231,023 B2 * 7/2012 Petyhyrycz ..... 220/4.26
8,256,633 B2 * 9/2012 Rogers Martijena et al. 215/379
2001/0040164 A1 * 11/2001 Cleator ..... 220/501
2002/0130126 A1 * 9/2002 Rosenberg ..... 220/4.26
2003/0192894 A1 * 10/2003 Munns ..... 220/505
2007/0138176 A1 * 6/2007 Gawlick ..... 220/4.26
2008/0179334 A1 * 7/2008 Abramson et al. ..... 220/568
2010/0219185 A1 * 9/2010 Griffin et al. ..... 220/4.07
2011/0309083 A1 * 12/2011 Hsiu-Tzu Charlene ..... 220/505

* cited by examiner

*Primary Examiner* — Anthony Stashick
*Assistant Examiner* — Christopher McKinley
(74) *Attorney, Agent, or Firm* — Sughrue Mion, PLLC

(57) ABSTRACT

Disclosed herein is a detachable coupling apparatus for a midsection of a separable bottle. The apparatus is configured such that upper and lower locking portions of a bottle are detachably coupled to each other by rotating upper and lower bodies in opposite directions, the upper and lower locking portions being inclined in a coupling direction. The present invention ensures the easy coupling for the midsection of the bottle in a single operation, and prevents unexpected separation of the bottle particularly when in the coupled state, thus continuously maintaining excellent watertight performance and stability.

4 Claims, 10 Drawing Sheets

DETACHABLE COUPLING APPARATUS FOR MIDSECTION OF SEPARABLE BOTTLE

BACKGROUND OF THE INVENTION

1. Field of the Invention

The present invention relates, in general, to separable bottles, such as water bottles, beverage bottles, thermos bottles, or baby bottles, which contain liquid and are configured to be separable at a midsection thereof and, more particularly, to a detachable coupling apparatus for a midsection of a separable bottle.

2. Description of the Related Art

Generally, a bottle including a water bottle is a container in which drinking water is stored, and is configured so that a mouth is formed on an upper portion thereof to allow water or liquid to be put into or discharged from the bottle, and a cap or a plug is provided to open or close the mouth.

However, such a bottle is problematic in that its mouth is a lot narrower than its body, so that it is not easy to wash the interior of the bottle because it should be washed using a dish sponge or brush provided on an end of a stick like a chopstick, and hence it is not easy to hygienically use the bottle repeatedly.

In order to solve the above problem, technologies intended to detachably couple the midsection of the bottle are disclosed in Korean Patent Laid-Open Publication No. 10-1999-0064574, U.M. Registration No. 20-0288636, U.M. Registration No. 20-0350790, U.M. Laid-Open Publication No. 20-2009-0003800, etc.

FIGS. 1A and 1B are views showing a typically conventional separable bottle, in which FIG. 1A shows the coupled state of the water bottle, and FIG. 1B shows the separated state of the water bottle. Here, the bottle, i.e. the water bottle is configured so that its midsection is separated into an upper body 11 and a lower body 12, with separated portions being fastened to each other by means of an external threaded portion 13 and an internal threaded portion 14.

The conventional separable bottle configured as described above allows its interior to be washed, sterilized or dried after the bottle has been separated into the upper body 11 and the lower body 12, as shown in FIG. 1B, when one desires to wash the interior, thus making it possible for the bottle to be used more hygienically and cleanly.

On the one hand, in the case of using the water bottle, the external threaded portion 13 of the upper body 11 is fastened to the internal threaded portion 14 of the lower body 12. An O-ring type packing member is fitted to a separating plane S at which the external threaded portion 13 engages with the internal threaded portion 14, thus enhancing the water-tightness of the water bottle.

SUMMARY OF THE INVENTION

The aforementioned conventional separable bottle is problematic in that a threaded fastening structure is employed on the upper and lower bodies, so that threaded fastening portions of the upper and lower bodies may become unfastened and loose due to the shaking of the bottle or the like, and thus watertight performance may suffer, and water may leak out from the bottle if the drop in the watertight performance is too large, thus resulting in reduced product reliability.

Further, the conventional separable bottle is problematic in that the upper and lower bodies have the threaded fastening structure, so that the upper body or the lower body should be rotated several times in order to completely couple the upper and lower bodies with each other, and thus considerable effort should be made to carry out the separation and coupling of the upper and lower bodies.

Accordingly, the present invention has been made keeping in mind the above problems occurring in the prior art, and an object of the present invention is to provide a detachable coupling apparatus for a midsection of a separable bottle, capable of performing the detachable coupling of the midsection of the bottle in a convenient and easy way in a single operation.

Another object of the present invention is to provide a detachable coupling apparatus for a midsection of a separable bottle, configured so that the upper and lower bodies constituting the bottle are not easily unfastened from each other, thus continuously maintaining excellent watertight performance, and enhancing the reliability of the bottle.

In order to accomplish the above objects, the present invention provides a detachable coupling apparatus for a midsection of a separable bottle, wherein the midsection of the bottle comprising an upper body and a lower body is configured to enable detachable coupling, the midsection serving as a coupling portion between the upper body and the lower body being provided with a watertight member for maintaining water-tightness, the upper body and the lower body having on respective ends thereof upper and lower watertight support portions that are in close contact with respective upper and lower surfaces of the watertight member, the upper body has a plurality of upper locking portions protruding inwards on a lower end of an upright flange that extends from the upper watertight support portion through a first flange, and the lower body has on an upper end thereof a plurality of lower locking portions protruding outwards, thus causing the upper and lower bodies to be detachably coupled to each other as the upper and lower bodies rotate in opposite directions, the upper and lower locking portions are formed to be inclined in a coupling direction, at least either of the upper and lower locking portions being inclined in a direction in which the watertight member is compressed to some extent in an initial coupling section of the upper and lower locking portions, at least either of the upper and lower locking portions being inclined in a direction in which the watertight member compressed in the initial coupling section is partially restored as coupling of the upper and lower locking portions is further progressed in a section following the initial coupling section, and the watertight member maintains a compressed state between the upper and lower bodies when the coupling of the upper and lower locking portions is completed.

At least either of the upper and lower locking portions may comprise a stopper to prevent further rotation when the coupling of the upper and lower locking portions is completed.

A pressing line of the upper watertight support portion of the upper body for pressing an upper surface of the watertight member and a pressing line of the lower watertight support portion of the lower body for pressing a lower surface of the watertight member do not align with each other at the same diameter, the pressing lines being arranged, respectively, at inner and outer positions of the watertight member in such a way as to be offset from each other in each radial directions of the upper and lower bodies.

Further, the upper watertight support portion and the upper locking portion may not be connected to each other, and the upper body may be provided with a upper coupling to be detachably coupled to the lower locking portion of the lower body, and the upper coupling may include a second flange rotatably locked to a first flange that protrudes outwards from the upper watertight support portion of the upper body, an upright flange extending downwards from an outer end of the second flange to the upper locking portion, and an upper locking portion extending inwards from a lower end of the upright flange to be detachably coupled to the lower locking portion.

Furthermore, the lower watertight support portion and the lower locking portion may not be connected to each other, and the lower body may be provided with a lower coupling to be detachably coupled to the upper locking portion of the upper body, and the lower coupling may include a fourth flange rotatably locked to a third flange that protrudes outwards from the lower watertight support portion of the lower body, an upright flange extending upwards from an outer end of the fourth flange, and a lower locking portion extending outwards from an upper end of the upright flange.

The aforementioned main solutions of the present invention will be explicitly described in detail with reference to the following description of the invention or the accompanying drawings.

The detachable coupling apparatus for the midsection of the separable bottle according to the present invention is advantageous in that it performs the detachable coupling of the midsection of the bottle in a convenient and easy way in a single operation.

Further, the present invention is advantageous in that coupled portions of upper and lower bodies do not easily become unfastened from each other, thus continuously maintaining excellent watertight performance, therefore providing high stability and reliability for a bottle.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF PREFERRED EMBODIMENTS

Hereinafter, the preferred embodiments of the present invention will be described with reference to the accompanying drawings.

Referring to FIGS. 2 to 7, an embodiment of the present invention will be described in detail.

Figure 1A:
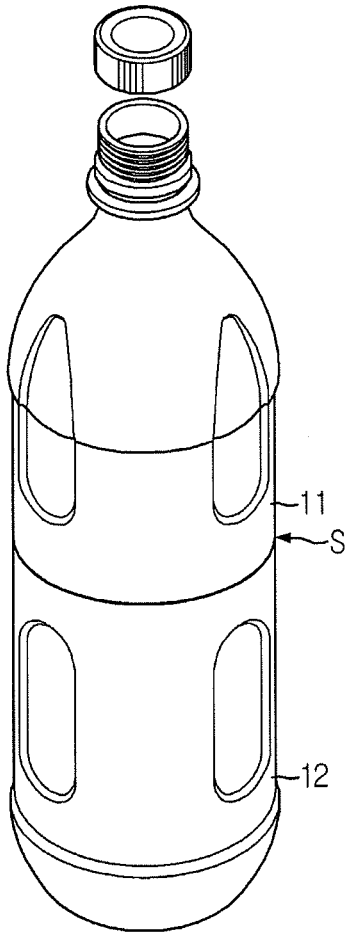
FIGS. 1A and 1B are views showing a conventional separable bottle.
Figure 1B:
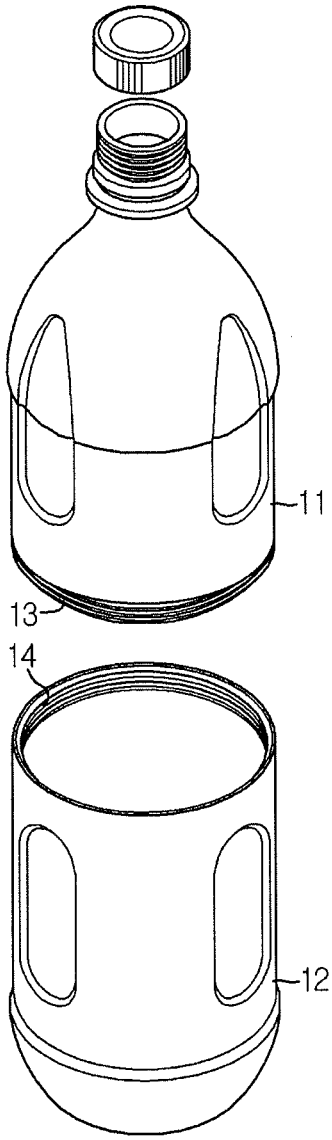
Figure 2:
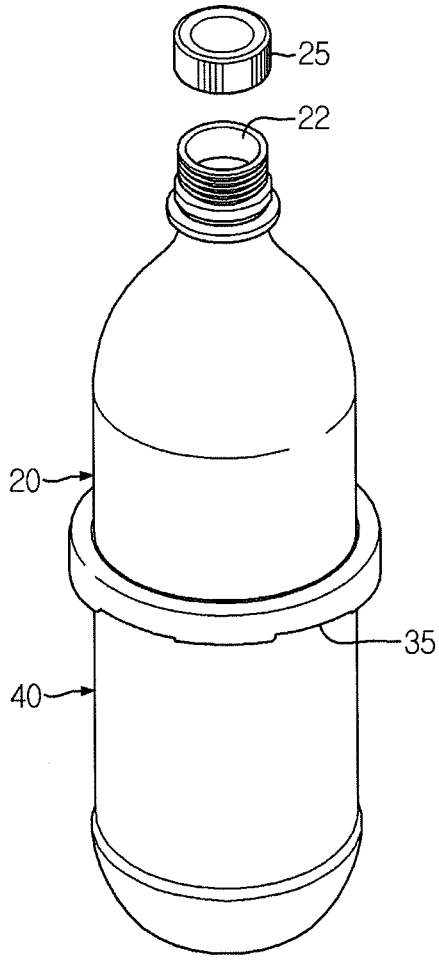
FIG. 2 is an assembled perspective view showing a separable bottle, to which a detachable coupling apparatus according to an embodiment of the present invention is applied.
Figure 3:
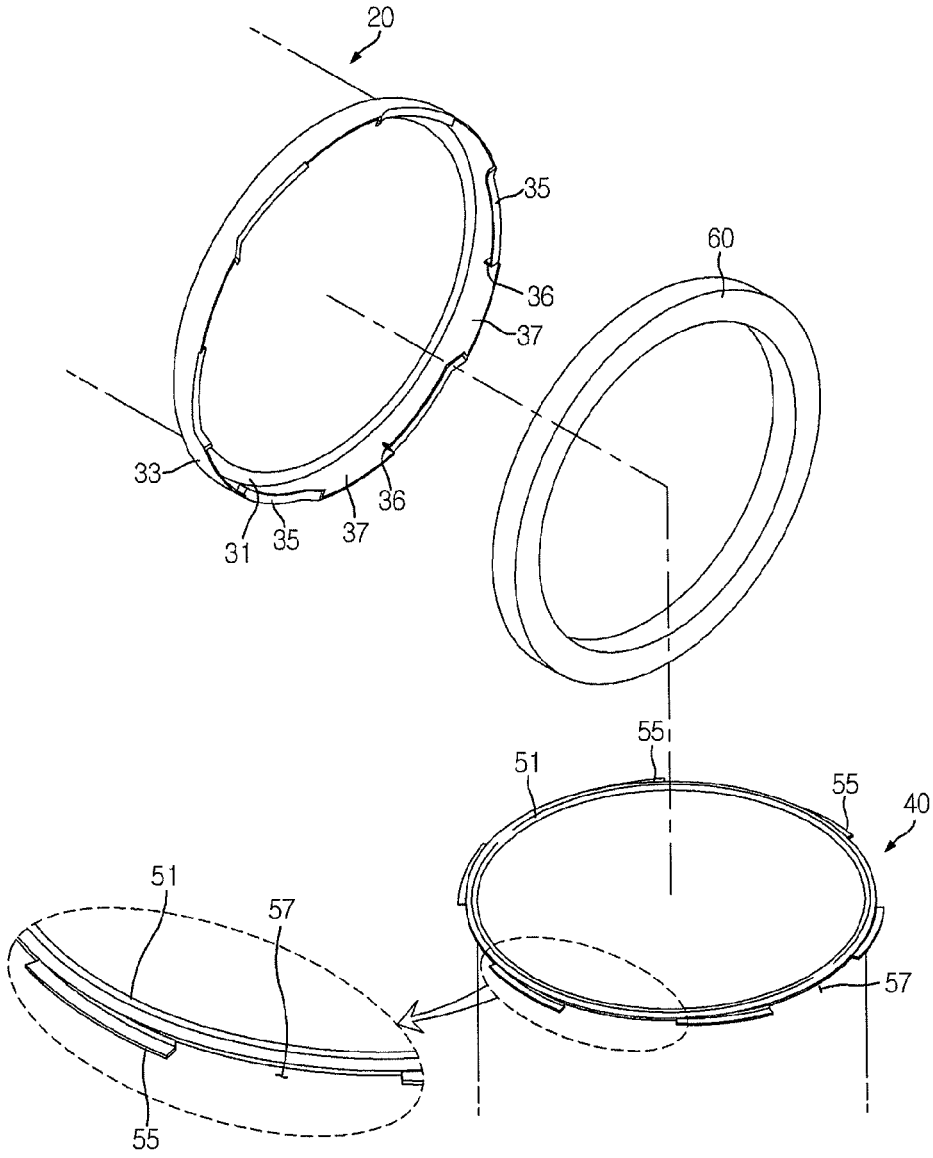
FIG. 3 is an exploded perspective view showing a detachable coupling apparatus, i.e. an important part of the present invention, with the apparatus having been extracted from the bottle of FIG. 2.
Figure 4:
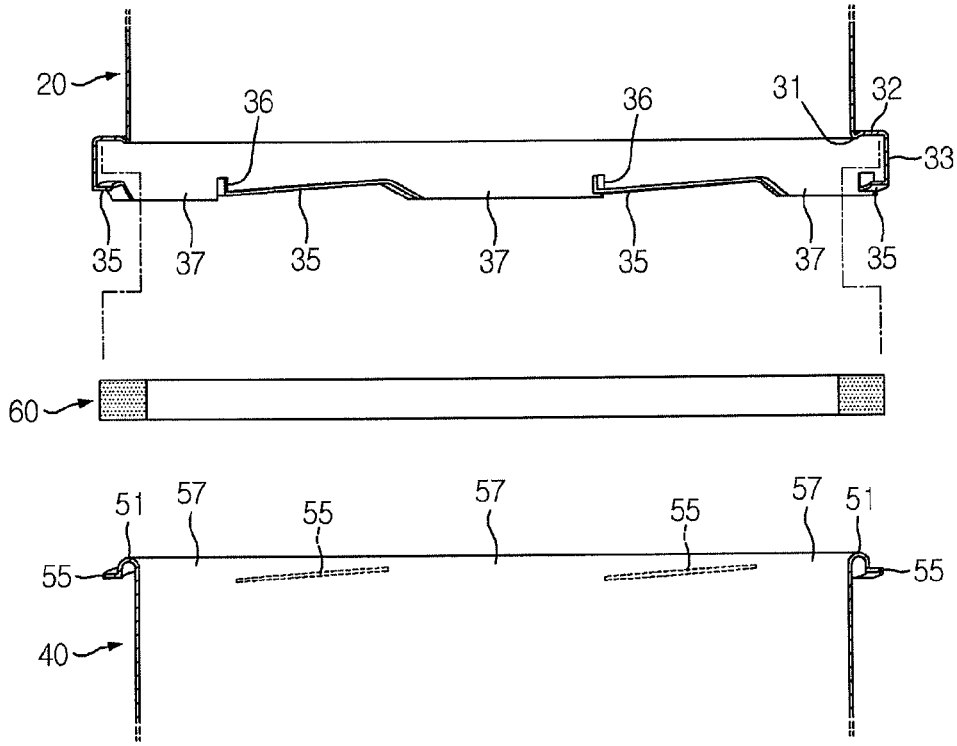
FIG. 4 is an exploded sectional view of FIG. 3 which is the important part of the present invention.

FIG. 2 is an overall perspective view showing a separable bottle having a detachable coupling apparatus according to the present invention. In this context, the separable bottle is essentially configured so that an upper body 20 and a lower body 40 are separated from and then are coupled to each other, thus forming one bottle.

The upper body 20 is part of the bottle and is open at upper and lower ends thereof, and an upper portion of the upper body 20 is gradually narrower than the lower end thereof that is to be coupled to the lower body 40 as in a general bottle, with a mouth 22 being formed in the upper end of the upper body to allow liquid to be put into or discharged from the bottle. The mouth 22 is configured to be open or closed by a cap or a plug 25. Various known structures for opening or closing bottles may be employed as a structure for opening or closing the mouth.

The lower body 40 is preferably closed at a lower portion as well as a circumferential surface thereof, except for a portion that is to be coupled to the lower end of the upper body 20.

Such upper and lower bodies 20 and 40 are fastened to each other through the coupling structure in such a way as to be detachable when necessary, for example, when washing the bottle. The coupling structure of the upper body 20 with the lower body 40 is illustrated in detail with reference to FIGS. 3 to 5 and FIG. 7.

A watertight member 60 is interposed in a coupling portion between the upper body 20 and the lower body 40 (hereinafter also referred to as 'upper and lower bodies') to prevent fluid from leaking out from the bottle. The watertight member 60 is in a flexible and resilient ring-type structure to be positioned between the upper and lower bodies 20 and 40, and is preferably made of rubber or synthetic resin material that is used for conventional packing.

Further, the watertight member 60 may be configured to be mounted between an upper watertight support portion 31 and an upper locking portion 35 that will be described below. Such a watertight member 60 may appropriately set its shape depending on the structure of a mounting space.

The upper body 20 and the lower body 40 are provided with upper and lower watertight support portions 31 and 51, respectively, to support the watertight member 60 while coming into close contact with upper and lower portions thereof. That is, the upper watertight support portion 31 is provided on a lower end of the upper body 20 to make close contact with an upper surface 61 of the watertight member 60, and the lower watertight support portion 51 is provided on an upper end of the lower body 40 to make close contact with a lower surface 62 of the watertight member 60. The upper watertight support portion 31 and the lower watertight support portion 51 are provided on the upper and lower portions of the watertight member 60 in such a way that they correspond to each other.

Now, a coupling structure provided at the coupling portion between the upper body 20 and the lower body 40 will be described in detail.

A first flange 32 is provided on the lower end of the upper body 20 and extends from the watertight support portion 31 to surround the upper surface of the watertight member 60, and an upright flange 33 extends downwards from an outer end of the first flange 32, with a plurality of upper locking portions 35 provided on a lower end of the upright flange 33 in such a way as to protrude inwards. Here, the method used to form the upper locking portions 35 may be one in which they are formed on the lower end of the upper body 20 in such a way as to extend inwards (a method of using injection molding or casting) or a method in which the lower end is bent inwards (a method of pressing a sheet material), etc.

A plurality of lower locking portions 55 is provided on the upper end of the lower body 40 in such a way as to protrude outwards from the lower watertight support portion 51. Here, the method used to form the lower locking portions may be that of extending them outwards from the lower watertight support portion 51 provided on the upper end of the lower body 40 or a method of bending the upper end outwards, etc.

The upper locking portions 35 and the lower locking portions 55 (hereinafter also referred to as 'upper and lower locking portions') are formed at regular intervals in circumferential directions of the upper and lower bodies, respectively. Here, upper and lower passing portions 37 and 57 are formed in space between the locking portions provided in the circumferential directions of the upper and lower bodies, respectively, to permit the locking portions of one body to pass through the passing portions of the other body.

In other words, the upper locking portions 35 are formed at regular intervals on the lower end of the upper body 20 in such a way as to protrude inwards. The upper passing portions 37 are formed between the protruding upper locking portions 35 to allow the lower locking portions 55 of the lower body 40 to pass therethrough when the upper and lower bodies 20 and 40 are coupled to or detached from each other. Similarly, the lower locking portions 55 protrude outwards from the lower watertight support portion 51 that is provided on the upper end of the lower body 40. The lower passing portions 57 are formed between the protruding lower locking portions 55 to allow the upper locking portions 35 to pass therethrough when the upper and lower bodies 20 and 40 are coupled to or detached from each other.

Figure 5:
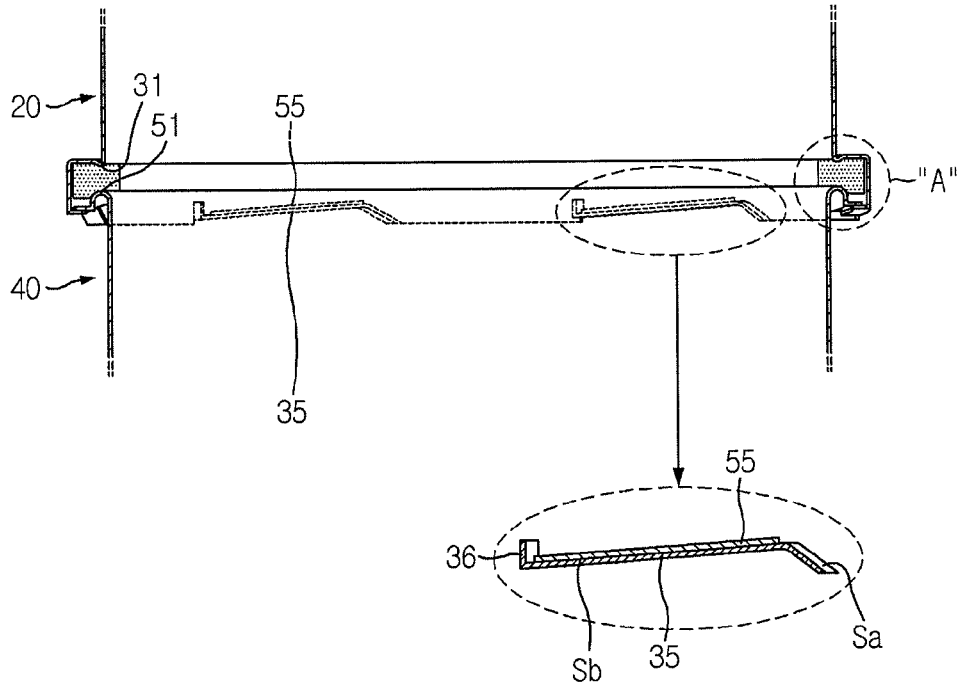
FIG. 5 is a sectional view showing a coupled state of FIG. 3 which is the important part of the present invention.
Figure 7:
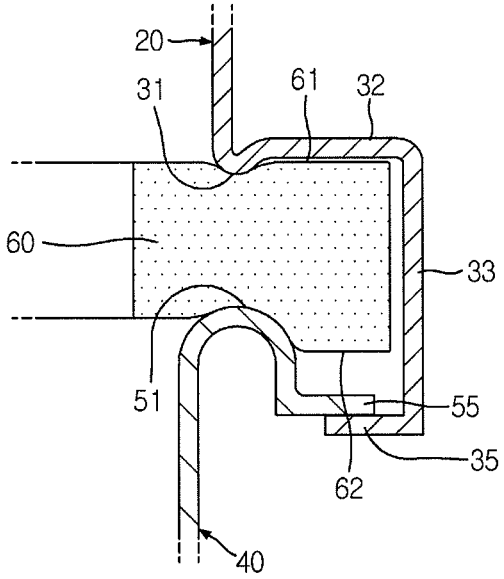
FIG. 7 is a detailed view showing portion "A" encircled in FIG. 5.

The upper body 20 and the lower body 40 are coupled to each other as follows: if the upper and lower locking portions 35 and 55 are fitted to pass through the corresponding lower and upper passing portions 57 and 37 using the above-mentioned structure of the upper locking portion 35 and the lower locking portion 55, and then either of the upper body 20 or the lower body 40 is rotated in a coupling direction, as shown in FIGS. 5 and 7, the upper locking portions 35 move below the lower locking portions 55, so that the coupling of the upper body 20 with the lower body 40 is achieved.

By contrast, when the upper body 20 and the lower body 40 are detached from each other, the upper body 20 and the lower body 40 are rotated in a detaching (unlocking) direction that is opposite the coupling (locking) direction. In this case, the upper and lower locking portions 35 and 55 are situated below and above the corresponding lower and upper passing portions 57 and 37, respectively. As a result, the upper locking portions 35 are disengaged from the lower locking portions 55, so that the upper body 20 is naturally detached from the lower body 40.

The upper and lower locking portions 35 and 55 coupled to and detached from each other as described above are inclined in the coupling direction. At least either the upper locking portions 35 or the lower locking portions 55 are configured to permit easy coupling and avoid detachment as long as an artificial external force is not applied thereto.

In other words, an initial coupling section of the upper and lower locking portions is inclined (hereinafter referred to as an 'approach sloping surface Sa') in a direction in which the watertight member 60 is compressed to some extent. A section (hereinafter referred to as a 'coupling sloping surface Sb') following the initial section is inclined in a direction in which the watertight member 60 compressed in the initial section is partially restored as the coupling of the upper and lower locking portions 35 and 55 is further progressed. Although the coupling of the upper locking portions 35 with the lower locking portions 55 is completed, the upper and lower watertight support portions 31 and 51 of the upper and lower bodies 20 and 40 keep the watertight member 60 compressed.

FIG. 5 shows a configuration having the coupling sloping surface Sb of the upper locking portion 35 and an approach sloping surface Sa formed in front of the coupling sloping surface. Although not illustrated in the drawings, the approach sloping surface Sa may also be formed in front of the coupling sloping surface Sb of the lower locking portion 55 in the same manner, and the approach sloping surface Sa may be formed on both the upper and lower locking portions 35 and 55 as well.

Further, at least either of the upper locking portion 35 or the lower locking portion 55 is provided with a stopper 36 to prevent further rotation once the upper and lower locking portions 35 and 55 have been coupled to each other.

As long as the stopper 36 prevents the upper and lower bodies 20 and 40 from rotating any more with respect to each other when the upper and lower locking portions 35 and 55 have been coupled to each other, the stopper may be formed on any of coupling portions of the upper and lower bodies 20 and 40 without being limited to the configuration wherein the stopper is formed on either of the upper or lower locking portion 35 or 55. For example, a protrusion serving as the stopper may be formed in the space between the upper locking portions 35 to catch the lower locking portion 55, thus preventing further rotation.

Now, the inclined coupling structure for the upper and lower locking portions 35 and 55 will be described in detail with reference to FIGS. 6 and 7.

In the drawings, reference numeral 35 denotes one of the upper locking portions of the upper body, and reference numeral 55 denotes one of the lower locking portions of the lower body. Furthermore, reference numeral 60 denotes an imaginary watertight member. The reason why the imaginary watertight member is placed on a side of the upper and lower locking portions 35 and 55 in the drawing is because it shows a deformation (compression or restoration) state depending on the coupled state of the upper locking portion 35 with the lower locking portion 55.

The deformed state of the watertight member 60 is explained depending on the position at which the upper locking portion 35 is coupled with the lower locking portion 55. Here, it is assumed that the upper surface 61 of the watertight member 60 is not deformed while maintaining contact with the upper watertight support portion 31.

The process of coupling the upper and lower bodies 20 and 40 is as follows: if the lower body 40 is rotated (in a direction from right to left in the drawing) and thus a point P of the lower locking portion 55 reaches a position S1 of the upper locking portion 35 in an initial stage, the watertight member 60 is barely compressed and the lower watertight support portion 51 of the lower body 40 is put in contact with the lower surface 62 of the watertight member 60.

In such a state, if the lower body 40 continues to rotate so that the point P slides up along the approach sloping surface Sa from the first position S1 to another position S2, the lower watertight support portion 51 is also moved up as the result of the upward movement of the point P, thus compressing the watertight member 60 in proportion to an upward moving distance of the lower watertight support portion 51. Consequently, the lower surface 62 of the watertight member 60 is compressed to level L2.

In such a state, if the lower body 40 is further rotated so that the point P reaches a position S3, the lower watertight support portion 51 moves downwards as the point P moves downwards to some extent, thus causing the watertight member 60 to be relaxed in proportion to a downward moving distance of the lower watertight support portion 51. That is, the lower surface 62 of the watertight member 60 is relaxed to the position of level L3. Although the watertight member 60 is relaxed to the position of level L3 as such, it is not in a completely relaxed (restored) state up to level L1. Hence, the watertight member 60 maintains a compressed state between the upper watertight support portion 31 and the lower watertight support portion 51, thus realizing the water-tight function.

In the detachable coupling apparatus for the midsection of the separable bottle according to the present invention configured as described above, the process of coupling the upper and lower locking portions 35 and 55 of the upper and lower bodies 20 and 40 will be described in more detail.

First, when the lower body 40 is rotated relative to the upper body 20 to couple the upper and lower locking portions 35 and 55 with each other, the lower body 40 should be rotated as compressing the watertight member 60 to cause the point P of the lower locking portion 55 to slide up from position S1 to position S2 of the upper locking portion 35 in the initial stage. To this end, a momentary strong rotation is required.

If the lower locking portion 55 continues to rotate after the point P of the lower locking portion 55 has moved up to position S2 through such a momentary strong rotation, the watertight member 60 is expanded (restored) from level L2 to level L3. A restoring force of the watertight member 60 generated in this case acts as a force that helps the lower locking portion 55 rotate to position S3 with ease.

Accordingly, when the upper and lower bodies 20 and 40 are coupled to each other, a momentary force is applied to perform the rotation in the initial coupling stage, and subsequently the restoring force of the watertight member 60 is added, so that the coupling is easily achieved. Consequently, coupling of the upper and lower bodies in a manner similar to one-touch coupling is made possible.

The stability of using the bottle filled with water where the upper body 20 is coupled with the lower body 40 will be described for reference.

Figure 6:
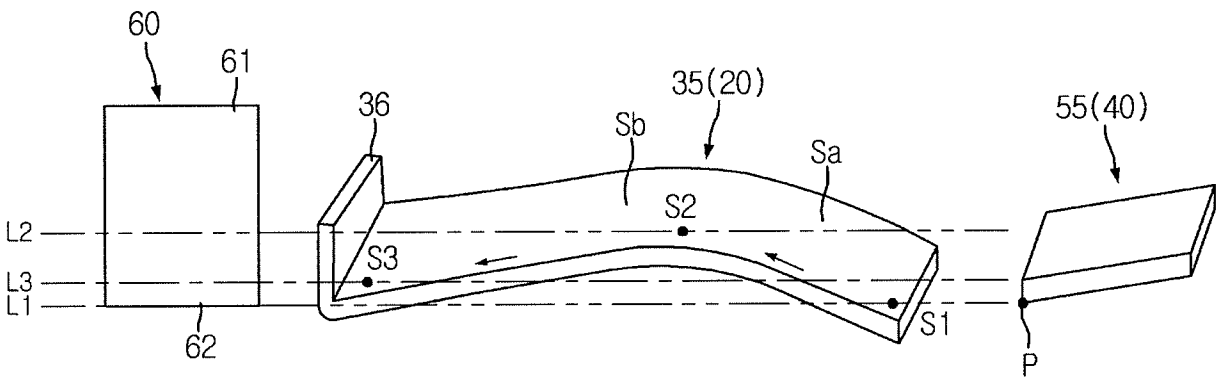
FIG. 6 is a view illustrating an inclined coupling structure of an upper locking portion with a lower locking portion in the present invention.

In order to detach the upper and lower bodies 20 and 40 from each other in the separable bottle according to the present invention, the point P of the lower locking portion 55 which is in position S3 of the upper locking portion 35 in FIG. 6 should move upwards to position S2 of the upper locking portion 35 and then downwards to position S1. However, in order to move upwards from position S3 to position S2, the rotating force for compressing the watertight member 60 from level L3 to level L2 should be applied to the upper body 20 and the lower body 40 simultaneously and continuously in the same direction (during the movement of the point P from position S3 to position S2).

Such a release of the coupling, that is, the unfastening, may occur only if the bottle is subjected not to a natural external force but only to an artificial external force i.e. a force intended to detach the upper and lower bodies from each other. In other words, the inherent elastic force of the watertight member 60 that is resistant to compression from level L3 to L2 serves to prevent the separation of the coupling structure of the upper and lower bodies according to the present invention against the external force that is unexpectedly and unintentionally generated.

As a result, the separable bottle according to the present invention is not easily detached during use if there is no intention to detach it, thus improving stability and reliability.

Figure 8:
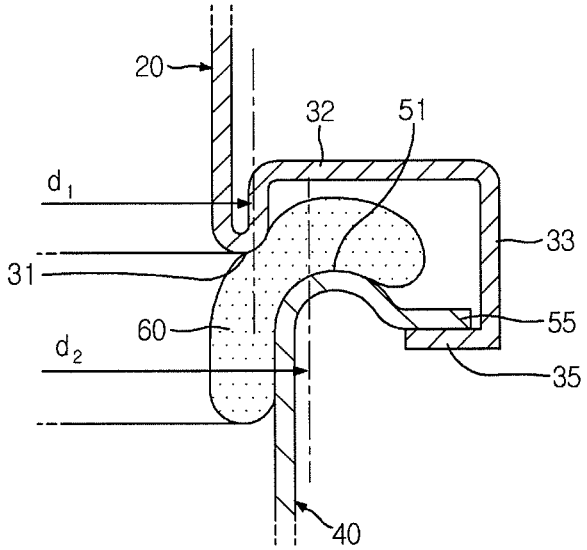
FIGS. 8 to 10 are detailed sectional views showing other embodiments of important parts of the detachable coupling apparatus of the present invention.

FIG. 8 is a detailed sectional view showing another embodiment of an important part of the detachable coupling apparatus for the midsection of the separable bottle according to the present invention.

In the embodiment of FIG. 8, a pressing line of the upper watertight support portion 31 of the upper body 20 for pressing the upper surface of the watertight member 60, and a pressing line of the lower watertight support portion 51 of the lower body 40 for pressing the lower surface of the watertight member 60 do not align with each other, at a same diameter, but the pressing lines are arranged, respectively, at inner and outer positions of the watertight member 60 in such a way as to be offset from each other in each radial directions of the upper and lower bodies 20 and 40. Preferably, the watertight member 60 has an arc-shaped section to cover the upper surface of the lower watertight support portion 51 on the inner circumferential surface of the upper end of the lower body 40.

As shown in FIG. 8, a diameter d1 of the pressing line of the upper watertight support portion 31 may be smaller than a diameter d2 of the pressing line of the lower watertight support portion 51, and vice versa.

The aforementioned pressing line means a line connecting a central portion of each of the upper and lower watertight support portions 31 and 51 that intensively press the watertight member 60.

If the diameters of the pressing lines of the upper and lower watertight support portions 31 and 51, formed at the inner and outer positions of the watertight member 60, are different from each other, the compressive force can be more intensively applied to the watertight member 60 between the two upper and lower pressing lines, as a result of which an improvement in watertight performance can be expected.

That is, the pressing lines (hereinafter also referred to as 'upper and lower pressing lines') of the upper and lower watertight support portions 31 and 51 not aligned with each other but offset from each other move and apply vertical force to the watertight member 60 in opposite directions, thus compressing the watertight member 60. In this case, the two upper and lower pressing lines of the upper and lower watertight support portions 31 and 51 are on inclined sides.

Here, the force applied to the watertight member 60 is equal to the sum of vertical force applied along the upper and lower watertight support portions 31 and 51 and the force generated in a lateral direction between the pressing lines. Thus, this results in increasing compressive force being applied to the watertight member 60, so that better watertight performance is ensured.

Further, in order to reduce frictional force between the upper and lower locking portions 35 and 55 when the upper and lower locking portions 35 and 55 of the present invention are coupled to or separated from each other, a structure for reducing the contact area may be formed on at least one of the upper and lower locking portions. This is configured to reduce the contact area between the upper and lower locking portions. By way of example, a rib (it is preferably long in the coupling direction) or a circular protrusion, which protrudes towards a corresponding locking portion, may be formed on either of the upper or lower locking portion.

As such, if the rib or the circular protrusion formed on either of the upper or lower locking portion comes into contact with a corresponding locking portion while the coupling or separating operation is being carried out, the frictional force between the upper and lower locking portions can be reduced, and thus the upper and lower bodies of the bottle can be more easily coupled to or detached from each other. Further, another method of reducing the frictional force between the upper and lower locking portions 35 and 55 is to form a locking portion corresponding to the locking portion having an approach or coupling sloping surface Sa or Sb that is configured in a roller fashion.

Since such a structure for reducing the frictional force may be carried out by those skilled in the art, it is not illustrated in the drawings.

Figure 9:
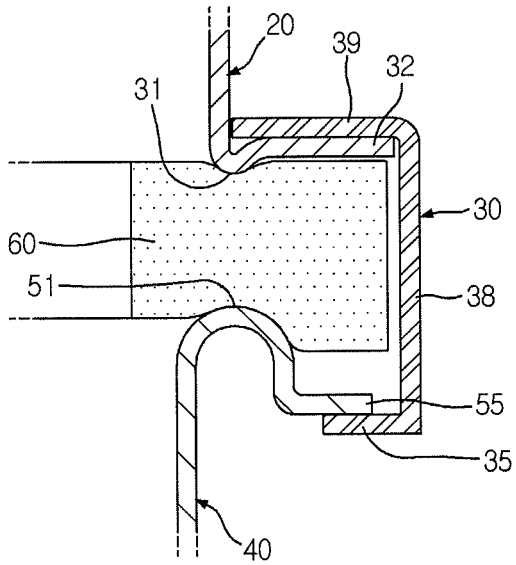
Figure 10:
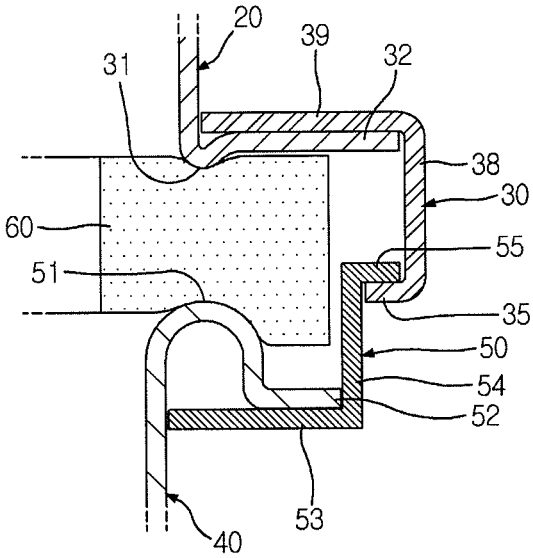

FIGS. 9 and 10 are detailed sectional views showing other embodiments of an important part of the detachable coupling apparatus for the midsection of the separable bottle according to the present invention.

Referring to FIG. 9, a portion between the upper watertight support portion 31 of the upper body 20 and the upper locking portion 35 is provided with a separate upper coupling 30, which is locked to the first flange 32 of the upper body 20.

That is, the upper coupling 30 has a second flange 39 to be locked to the first flange 32 that extends outwards from the upper watertight support portion 31 of the upper body 20.

An upright flange 38 extends downwards from an outer end of the second flange 39 to the upper locking portion 35. Further, the upper locking portion 35 is provided on a lower end of the upright flange 38 in such a way as to extend inwards, and is detachably coupled to the lower locking portion 55. The upper coupling 30 should be provided to perform a free movement in a longitudinal direction of the upper body 20 as well as a rotation in a circumferential direction of the upper body 20.

When one desires to couple the upper and lower bodies 20 and 40 configured as described above, the upper coupling 30 moves towards the lower body 40, and then the upper coupling 30 or the lower body 40 is rotated to cause the upper locking portion 35 to be coupled to the lower locking portion 55 as in the aforementioned several embodiments, so that the upper and lower bodies 20 and 40 are coupled to each other. Here, since the second flange 39 of the upper coupling 30 is supported on the first flange 32 of the upper body 20 as shown in FIG. 9, the upper watertight support portion 31 and the lower watertight support portion 51 press the watertight member 60 to be put in close contact therewith.

Herein, only the embodiment in which the upper coupling 30 is provided on the upper body 20 to perform the detachable coupling of the upper and lower bodies 20 and 40 has been described. However, by contrast, a lower coupling 50 may be provided on the lower body 40 to perform the detachable coupling of the upper and lower bodies 20 and 40, although not illustrated in the drawings.

FIG. 10 is a view showing a configuration where a pair of couplings is employed on a coupling portion of the upper and lower bodies 20 and 40. The upper body 20 is provided with the upper coupling 30, and the lower body 40 is provided with the lower coupling 50, so that the upper and lower couplings 30 and 50 take part in the detachable coupling in pairs.

To be more specific, the lower coupling 50 has a fourth flange 53 that is locked to the third flange 52, with the third flange 52 extending outwards from the lower watertight support portion 51 of the lower body 40. An upright flange 54 extends upwards from an outer end of the fourth flange 53, and a lower locking portion 55 extends outwards from an upper end of the upright flange 54.

The upper coupling 30 is provided in the same configuration as described above. That is, since the upper coupling 30 is equal to that of FIG. 9 except that the upright flange 38 becomes shorter to detachably couple the upper locking portion 35 of the upper coupling 30 to the lower locking portion 55 of the lower coupling 50, a detailed description thereof will be omitted.

The upper and lower bodies 20 and 40 configured as described above are coupled to each other by rotating the upper and lower couplings 30 and 50 so as to couple the upper and lower locking portions 35 and 55, with the watertight member 60 being interposed between the upper watertight support portion 31 and the lower watertight support portion 51, so that the upper and lower bodies 20 and 40 are consequently coupled to each other. Here, the fourth flange 53 of the lower coupling 50 is supported on the third flange 52 of the lower body 40 and the second flange 39 of the upper coupling 30 is supported on the first flange 32 of the upper body 20 so that the lower and upper couplings 50 and 30 are pressed against and coupled to the lower and upper bodies 40 and 20. Hence, the upper watertight support portion 31 and the lower watertight support portion 51 are in close contact with the watertight member 60.

Figure 11:
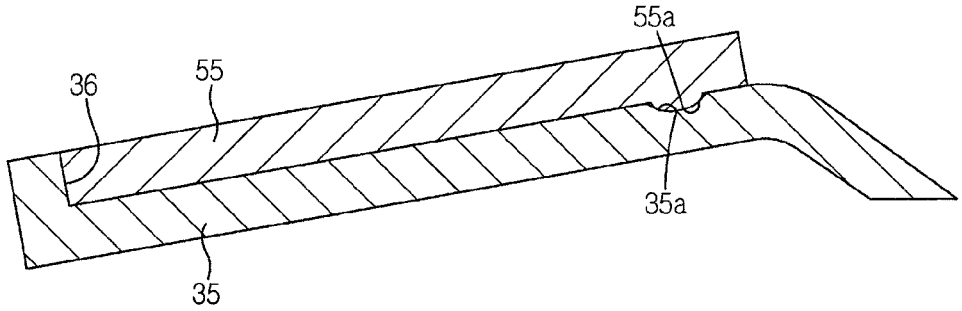
FIGS. 11 and 12 are views illustrating other embodiments of upper and lower locking portions in the present invention.
Figure 12:
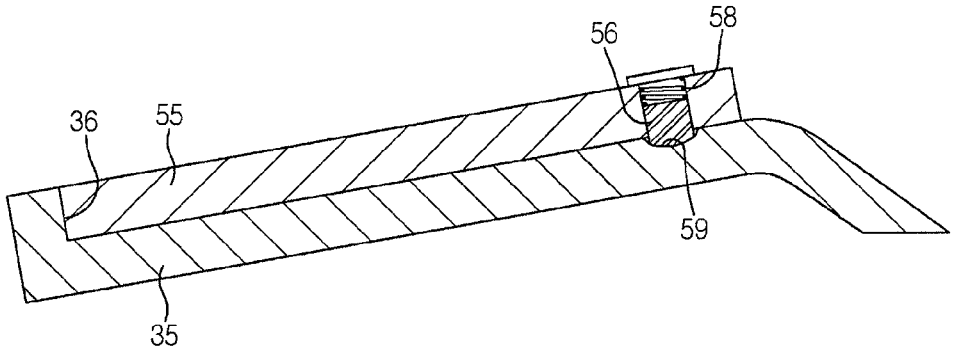

FIGS. 11 and 12 are views showing other embodiments of the upper and lower locking portions 35 and 55 to which the upper and lower bodies 20 and 40 of the present invention are coupled.

Referring to FIG. 11, a concave depression 35*a* is formed in an upper surface of the upper locking portion 35, while a convex protrusion 55*a* is formed on a lower surface of the lower locking portion 55 to be inserted into the depression 35*a* of the upper locking portion 35. When the depression 35*a* and the protrusion 55*a* that have been formed, respectively, on the upper locking portion 35 and the lower locking portion 55 completely engage with each other, the coupling of the upper and lower locking portions 35 and 55 is more reliable.

Referring to FIG. 12, a locking pin 56 is provided on the lower locking portion 55 and a pin hole 59 is correspondingly formed in the upper locking portion 35, so that the locking pin 56 is inserted into the pin hole 59. The locking pin 56 is preferably subjected to the elastic force of a spring 58.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

As described above, the present invention can be usefully applied to a separable bottle that is deep or small at its mouth, such as a water bottle, a beverage bottle, or a thermos bottle, among containers for storing liquids such as drinking water.

What is claimed is:

1. A detachable coupling apparatus for a midsection of a separable bottle, wherein the midsection of the bottle comprising an upper body and a lower body is configured to enable detachable coupling, the midsection serving as a coupling portion between the upper body and the lower body being provided with a watertight member for maintaining watertightness, the upper body and the lower body having on respective ends thereof upper and lower watertight support portions that are in close contact with respective upper and lower surfaces of the watertight member;

the upper body has a plurality of upper locking portions protruding inwards on a lower end of an upright flange that extends from the upper watertight support portion through a first flange, and the lower body has on an upper end thereof a plurality of lower locking portions protruding outwards, thus causing the upper and lower bodies to be detachably coupled to each other as the upper and lower bodies rotate in opposite directions;

the upper and lower locking portions are formed to be inclined in a coupling direction thereof, at least either of the upper and lower locking portions have a first sloping surface inclined in a direction in which the watertight member is compressed to a predetermined extent in an initial coupling section of the upper and lower locking portions and a second sloping surface inclined in a direction in which the compressed watertight member is restored to a predetermined extent as coupling of the upper and lower locking portions is further progressed;

wherein the first sloping surface is in continuity with the second sloping surface;

wherein the first sloping surface begins with a first bottom point and is inclined upwardly from the first bottom point to a top point where the first sloping surface meets the second sloping surface, and the second sloping surface is inclined downwardly from the top point to a second bottom point; and wherein the top point is positioned to be higher than the first and the second bottom points, and the second bottom point is positioned to be higher than the first bottom point.

2. The detachable coupling apparatus as set forth in claim 1, wherein a pressing line of the upper watertight support portion of the upper body for pressing an upper surface of the watertight member and a pressing line of the lower watertight support portion of the lower body for pressing a lower surface of the watertight member do not align with each other at the same diameter, the pressing lines being arranged, respectively, at inner and outer positions of the watertight member in such a way as to be offset from each other in each radial directions of the upper and lower bodies.

3. The detachable coupling apparatus as set forth in claim 1, wherein the upper watertight support portion and the upper locking portion are not connected to each other, and the upper body is provided with a separate upper coupling to be detachably coupled to the lower locking portion of the lower body, and the upper coupling comprises:

a second flange locked to a first flange that protrudes outwards from the upper watertight support portion of the upper body;

an upright flange extending downwards from an outer end of the second flange to the upper locking portion; and an upper locking portion extending inwards from a lower end of the upright flange to be detachably coupled to the lower locking portion.

4. The detachable coupling apparatus as set forth in claim 1, wherein the lower watertight support portion and the lower locking portion are not connected to each other, and the lower body is provided with a separate lower coupling to be detachably coupled to the upper locking portion of the upper body, and the lower coupling comprises:

a fourth flange locked to a third flange that protrudes outwards from the lower watertight support portion of the lower body;

an upright flange extending upwards from an outer end of the fourth flange; and a lower locking portion extending outwards from an upper end of the upright flange.

* * * * *